United States Patent [19]

Kohler

[11] 4,010,570

[45] Mar. 8, 1977

[54] PUPPET ASSEMBLING

[75] Inventor: Marc W. Kohler, Providence, R.I.

[73] Assignee: The Puppet Workshop, Inc., Providence, R.I.

[22] Filed: May 14, 1975

[21] Appl. No.: 577,410

[52] U.S. Cl. ..... 46/154

[51] Int. Cl.[2] ..... A63H 3/14

[58] Field of Search ..... 46/154, 22, 11, 1 R, 46/156, 158

[56] References Cited

UNITED STATES PATENTS

| | | | |
|---|---|---|---|
| 683,857 | 10/1901 | Kilpatrick | 46/154 |
| 2,302,349 | 11/1942 | Renshaw | 46/154 |
| 2,433,555 | 12/1947 | Hulse | 46/154 X |

*Primary Examiner*—Louis G. Mancene
*Assistant Examiner*—Robert F. Cutting

[57] ABSTRACT

A puppet comprising a head and a costume, the head comprising a container filled with a resilient foam material squeezed therein, the material having a slitted portion extending into the container from its opening, the slitted portion providing a finger-receiving receptacle for manipulation of the head by a finger, and the costume being in the form of a mitten for receiving a hand, the head and costume being in assembled relation when a hand is inserted into the mitten and a finger of the hand is inserted into the slitted portion of the head.

4 Claims, 4 Drawing Figures

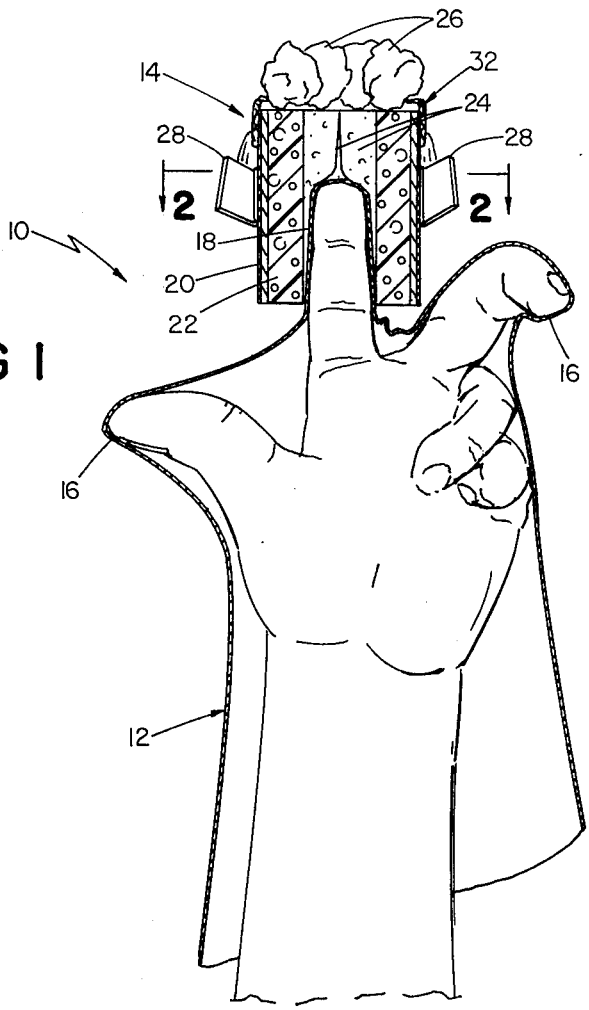
FIG 1
FIG 2
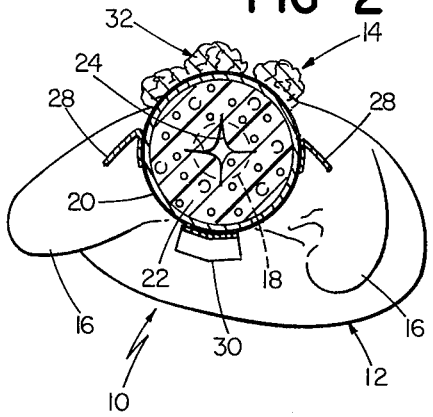
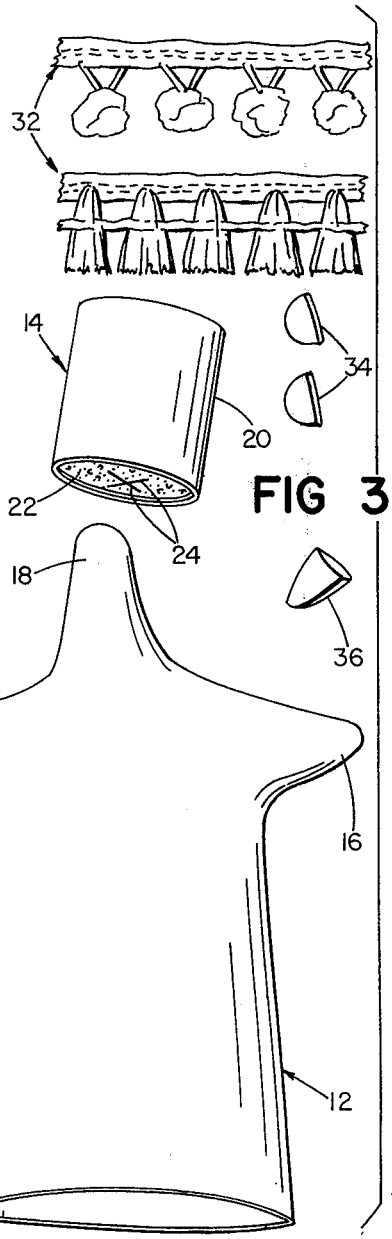
FIG 3
FIG 4
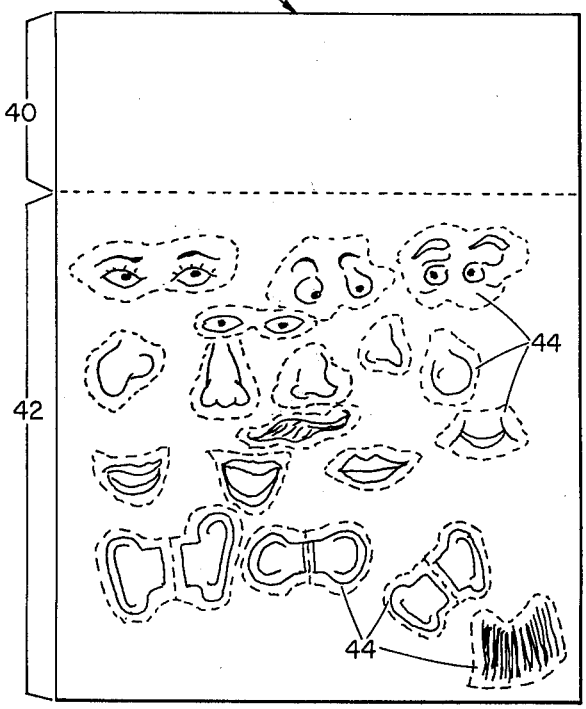

PUPPET ASSEMBLING

BACKGROUND OF THE INVENTION

This invention relates to puppets and puppet assembly kits.

In making puppets for children, one faces the problem of providing a connection between the child's finger and the head of the puppet that allows for effective manipulation of the head without slippage of the finger or discomfort thereto. Slocum U.S. Pat. No. 1,432,628 teaches a slotted disc in the puppet's head for gripping a costume-covered finger inserted therethrough. Reich U.S. Pat. No. 1,417,860 teaches an elastic finger-receiving cup in the puppet's head and hands. It is also desirable to have interchangeability of costumes and heads. Renshaw U.S. Pat. No. 2,302,349 accomplishes this by externally tying the costume to the head. Finally, it is desirable to let children make their own puppets by providing simple and workable means for achieving that purpose. Lerner et al. U.S. Pat. No. 3,660,926 teaches a kit for making a toy character from magnetic elements.

SUMMARY OF THE INVENTION

The invention provides a simple, cheap, easy to construct, and fun to use puppet.

The invention provides for effective finger control of the puppet head in a way that is comfortable to the finger, lasts after repeated uses, and requires no adjustment for different finger sizes. The costume is simply but effectively secured to the puppet head during use, but is easily interchangeable with other costumes. The invention enables a young child to construct his own workable puppet, and provides opportunity for creativity in decorating the puppet's head.

The invention features in one aspect a puppet comprising a head and a costume, the head comprising a container having an opening therein, the container filled with a resilient foam material squeezably held therein; the material having a slitted portion extending into the container from the opening, the slitted portion providing a finger-receiving receptacle for manipulation of the head by a finger, the costume being in the form of a mitten for receiving a hand, and the head and costume being in assembled relation when a hand is inserted into the mitten and a finger of the hand is inserted into the slitted portion. In another aspect the invention features a puppet assembly kit comprising the head with slitted finger-receiving foam portion, a costume, a plurality of decorative parts for attachment to the head, and a container for holding the head, costume, and decorative parts prior to assembly thereof.

Preferred embodiments feature a mitten having a tubular finger-receiving member projecting from the closed end of the mitten, the mitten being connected to the head when a finger is inserted into the tubular member and the finger and the tubular member are thereupon inserted into the slitted portion of the head; foam material slitted twice to provide two slits being perpendicular to each other; open celled foam material; polyurethane foam material; and a head having a container in the form of a tube having an opening at each end, the slitted portion extending from one end of the tube to its opposite end through the axis of the tube.

Other advantages and features of the invention will be apparent from the description and drawings herein of a preferred embodiment thereof.

BRIEF DESCRIPTION OF THE DRAWINGS

FIG. 1 is a view in cross section of one embodiment of the present invention.

FIG. 2 is a view through 2—2 of FIG. 1.

FIG. 3 is a view of an assembly kit embodiment of the present invention.

FIG. 4 is a plan view of indicia for use with the embodiment of FIG. 3.

DESCRIPTION OF THE PREFERRED EMBODIMENT

There is shown in FIG. 1 assembled puppet 10 comprising cloth costume mitten 12 and head 14. Mitten 12, also shown in FIG. 3, has three tubular finger-receiving portions 16, 16, and 18, portions 16 serving as the arms of the puppet and portion 18 for insertion into head 14. Head 14 comprises cardboard tube 20, open at both ends, and filled with a cylinder of resilient, open celled polyurethane foam 22 squeezed therein and glued to the inner surface of tube 20. Slits 24, 24 in foam 22 extend through the length of tube 20 along the axis thereof. Cotton balls 26 simulating hair cling by friction to the top of foam 22. Polystyrene foam pieces 28, 28, and 30 (FIG. 2) are glued to each side and front of tube 20, respectively, to simulate ears and a nose. Tasseled cloth strip 32 is glued around the top of tube 20 to simulate a headband.

FIG. 3 shows the disassembled parts comprising a puppet kit, including foam ears 34 and foam nose 36. Sheet 38 (FIG. 4) of colored construction paper can be used with the parts of FIG. 3 to construct a puppet. Top portion 40, when separated from the rest of sheet 38 along the dotted line, can be wrapped around and glued to tube 20 before any other parts are attached to give the tube a desired color. Lower portion 42 contains assorted humorous facial features 44 printed thereon. These features can be cut out and glued onto tube 20 to create a variety of faces. A transparent plastic bag (not shown) contains the parts of FIGS. 3 and 4.

In operation, after head 14 is decorated as above described, a user inserts his hand into mitten 12, placing the thumb and middle finger into tubular portions 16 and the index finger into tubular portion 18 (FIG. 1). Tubular portion 18 and finger therein are then inserted into the bottom of head 14 through perpendicular slits 24, spreading apart foam 22, until head 14 encloses tubular portion 18. The fingers in each tubular portion are then manipulated to provide the head and arm movements of the puppet. Squeezed foam 22 grips the finger snugly but without discomfort, and by being in contact with foam 22 throughout its length, the finger has optimum control over head movements.

Other embodiments are within the following claims.

What is claimed is:

1. A puppet comprising:

an exterior supporting tube and a unitary resilient foam core supported in said tube, at least one end of said tube being opened to expose said foam core, said foam core containing therein a longitudinally extending passage extending axially of said tube for receiving and gripping a finger extending through said one end, said foam core completely filling the crosssection of said tube between said passage and said tube to give stability thereto, said passage being transversely so small in area as to grip reliably even small fingers and said core being so yieldable as to accept reliably even large fingers.

2. The puppet of claim 1 further including a costume in the form of a mitten for receiving a hand, said tube and costume being in assembled relation when a hand is inserted into said mitten and a finger of said hand is inserted into said passage in said core.

3. The puppet of claim 2 wherein said mitten has a tubular finger-receiving member projecting from the closed end of said mitten, said mitten being connected to said tube when a finger is inserted into said tubular member and the finger and said tubular member are thereupon inserted into said passage in said core.

4. A puppet comprising:

a head comprising a container having an opening therein, said container filled with a resilient foam material squeezably held therein, said material having a slitted portion extending into said container from said opening, and said portion providing a finger-receiving receptacle for manipulation of said head by a finger, and a costume in the form of a mitten for receiving a hand, said head and costume being in assembled relation when a hand is inserted into said mitten and a finger of said hand is inserted into said slitted portion of said head, said container being in the form of a tube having an open end at each said end, said slitted portion extending from one end of said tube to the opposite end and through the axis of said tube.

* * * * *